US010988904B2

(12) United States Patent
Cooke et al.

(10) Patent No.: US 10,988,904 B2
(45) Date of Patent: Apr. 27, 2021

(54) SNOW AND ICE MELTING DEVICE, SYSTEM AND CORRESPONDING METHODS

(71) Applicants: Ian R. Cooke, Stonington, CT (US); Elizabeth T. Cooke, Stonington, CT (US)

(72) Inventors: Ian R. Cooke, Stonington, CT (US); Elizabeth T. Cooke, Stonington, CT (US)

( * ) Notice: Subject to any disclaimer, the term of this patent is extended or adjusted under 35 U.S.C. 154(b) by 389 days.

(21) Appl. No.: 15/675,578

(22) Filed: Aug. 11, 2017

(65) Prior Publication Data

US 2018/0051432 A1 Feb. 22, 2018

Related U.S. Application Data

(60) Provisional application No. 62/376,494, filed on Aug. 18, 2016.

(51) Int. Cl.
*E01H 5/10* (2006.01)
*E01H 5/09* (2006.01)

(52) U.S. Cl.
CPC ..... *E01H 5/104* (2013.01); *E01H 5/10* (2013.01); *E01H 5/102* (2013.01); *E01H 5/106* (2013.01); *E01H 5/09* (2013.01)

(58) Field of Classification Search
CPC ..... E01H 5/10; E01H 5/102; E01H 5/09
See application file for complete search history.

(56) References Cited

U.S. PATENT DOCUMENTS 168,890 A * 10/1875 Field ..... E02D 5/801 52/157
242,602 A * 6/1881 Clough ..... B67B 7/0411 81/3.45
429,111 A * 6/1890 Bailey ..... A01K 1/04 119/786
903,944 A * 11/1908 Andersen ..... E02D 5/80 52/156
907,799 A * 12/1908 Hawley ..... E02D 5/801 52/157

(Continued)

FOREIGN PATENT DOCUMENTS

CN 103147376 6/2013
EP 3499119 A1 * 12/2017
WO WO1990015958 12/1990

OTHER PUBLICATIONS

Priyanshu Dradhomar et al, "CFD Analysis of Double Tube Helical Coil Heat Exchanger for Different Heat Transfer Characteristics" article in International Journal of Advanced Research • Apr. 2017, uploaded as "Dradhomar CFD Analysis 2017.pdf" (Year: 2017).*

*Primary Examiner* — Avinash A Savani
*Assistant Examiner* — Martha M Becton
(74) *Attorney, Agent, or Firm* — UConn Law IP Clinic; Zhongyu Wang; Dorianne Salmon

(57) ABSTRACT

Disclosed herein is a device that is configured to melt at least one of snow and ice, comprising a coil formed from an elongated member having a first end and a second end, the elongated member having a surface comprising at least one of grooves, notches and pores configured to facilitate movement of liquid by capillary action. Corresponding methods and systems also are disclosed.

17 Claims, 11 Drawing Sheets

(56) References Cited

U.S. PATENT DOCUMENTS 942,337 A * 12/1909 Moore ..... E01H 5/102 126/343.5 R
1,203,179 A * 10/1916 Bowles ..... 219/213
1,519,673 A * 12/1924 Doble ..... F24H 3/087 126/90 R
1,881,610 A * 10/1932 Hyde ..... F28F 1/42 165/179
2,269,996 A * 1/1942 Webster ..... H01B 17/145 174/45 R
2,447,444 A * 8/1948 Waite ..... E02D 5/801 52/157
2,463,997 A * 3/1949 Rodgers ..... B21C 37/207 72/370.18
2,485,123 A * 10/1949 West ..... B23B 51/00 175/18
2,651,251 A * 9/1953 Clark ..... A47J 37/00 99/419
2,731,709 A * 1/1956 Gaddis ..... B21C 37/225 29/890.049
2,743,057 A * 4/1956 Backstrom ..... E01C 11/26 237/69
2,887,728 A * 5/1959 Usab ..... B29C 41/04 264/260
2,901,789 A * 9/1959 Frank ..... E02D 5/56 52/157
2,930,405 A * 3/1960 Welsh ..... F28F 13/06 138/38
3,183,675 A * 5/1965 Schroeder ..... E02D 19/14 405/130
3,217,791 A * 11/1965 Long ..... F24T 10/30 165/45
3,227,853 A * 1/1966 Gordon ..... E04D 13/08 219/213
3,267,564 A * 8/1966 Keyes ..... F28F 19/06 29/890.036
3,280,907 A * 10/1966 Hoffman ..... H01L 23/4093 165/185
3,528,494 A * 9/1970 Levedahl ..... F28D 15/046 165/104.26
3,584,683 A * 6/1971 Gordon ..... A47J 37/00 165/185
3,789,920 A * 2/1974 Low ..... F28D 15/046 165/104.26
3,857,441 A * 12/1974 Arcella ..... F28D 15/046 165/104.26
3,865,184 A * 2/1975 Grover ..... B21D 31/00 165/104.26
4,014,314 A 3/1977 Newton
4,036,286 A * 7/1977 Anderson ..... E02D 3/115 165/45
4,114,599 A 9/1978 Stephens
4,212,290 A 7/1980 Warnken
4,233,101 A * 11/1980 Scragg ..... B29C 63/345 156/287
4,279,294 A * 7/1981 Fitzpatrick ..... F28D 15/0241 165/45
4,407,351 A * 10/1983 Backlund ..... F24V 50/00 165/45
4,412,126 A * 10/1983 Brockway ..... H05B 3/44 165/183
4,420,918 A * 12/1983 Arnoux ..... A01K 3/005 411/411
4,440,215 A * 4/1984 Grover ..... B21C 37/205 122/366
4,487,256 A * 12/1984 Lutjens ..... F28F 1/20 165/183
4,646,818 A * 3/1987 Ervin, Jr. ..... E01C 11/26 126/271.1
4,657,074 A * 4/1987 Tomita ..... F24H 3/065 165/179
4,693,300 A * 9/1987 Adachi ..... E01C 11/26 165/45
4,716,819 A * 1/1988 Beltz ..... A21B 5/00 99/419
4,821,797 A * 4/1989 Allgauer ..... F16N 39/02 165/141
4,836,275 A * 6/1989 Sakaya ..... F24T 10/30 165/46
4,880,051 A * 11/1989 Ohashi ..... E04D 13/103 165/45
5,022,351 A * 6/1991 Daniels ..... A01K 1/04 119/789
5,029,633 A * 7/1991 Mann ..... F28D 15/02 165/45
5,054,541 A * 10/1991 Tripp ..... F24T 10/10 165/45
5,098,057 A * 3/1992 Gran ..... E02D 5/801 248/156
5,214,266 A * 5/1993 Halone, Jr. ..... E03C 1/122 219/201
5,240,353 A * 8/1993 Bower ..... B63B 21/26 405/259.1
5,252,016 A * 10/1993 Schmid ..... A47G 1/20 411/386
D347,948 S * 6/1994 McKnight ..... D3/10
5,339,890 A * 8/1994 Rawlings ..... F25B 30/06 165/45
5,358,209 A * 10/1994 Ward ..... E04H 12/2223 248/530
D363,616 S * 10/1995 Allen ..... D3/10
5,501,086 A * 3/1996 Sherlock ..... E05B 73/0005 248/530
5,526,774 A * 6/1996 Swindall, Jr. ..... A01K 1/04 119/787
5,605,418 A 2/1997 Watanabe et al.
5,630,447 A * 5/1997 Jensen ..... F16L 9/19 138/115
5,740,684 A * 4/1998 Sherlock ..... E05B 73/0005 248/530
D398,363 S * 9/1998 LoBue ..... D21/840
5,816,314 A * 10/1998 Wiggs ..... F24T 10/15 165/45
D402,803 S * 12/1998 Goldberg ..... D3/12
5,855,129 A * 1/1999 Warren ..... B62H 3/00 70/234
6,021,843 A * 2/2000 Roach ..... B62D 25/18 126/19.5
D421,532 S * 3/2000 Koroncai ..... D8/388
6,032,880 A * 3/2000 Verrills ..... E04H 12/2223 248/156
6,127,653 A * 10/2000 Samuels ..... E01C 11/265 219/213
6,128,867 A * 10/2000 MacKarvich ..... E02D 5/801 52/155
6,142,215 A * 11/2000 Paulsen ..... F28D 1/0213 165/128
6,321,861 B1 * 11/2001 Leichter ..... E04H 12/2223 135/99
D456,131 S * 4/2002 Dotson, Jr. ..... D3/10
6,412,235 B1 * 7/2002 Pylant ..... E02D 5/801 175/323
6,533,030 B2 * 3/2003 Mitrovic ..... F28F 1/40 138/38
D492,586 S * 7/2004 Rimer, Jr. ..... D8/393
6,810,630 B2 * 11/2004 Chizmas ..... A01K 1/04 52/155
6,846,142 B2 * 1/2005 Gens ..... F16B 25/00 411/411
D506,109 S * 6/2005 Deal ..... D7/683
D550,072 S * 9/2007 Ardern ..... D8/387
7,309,198 B1 * 12/2007 Brown ..... A01K 97/10 410/101
7,380,584 B2 * 6/2008 Ippoushi ..... F28D 15/0266 165/104.24
7,629,716 B2 * 12/2009 Neal ..... H02K 9/20 310/55
D630,834 S * 1/2011 Cohen ..... D3/10
D632,442 S * 2/2011 Beck ..... D30/154

(56) References Cited

U.S. PATENT DOCUMENTS

D658,046 S * 4/2012 Austin, III ..... D8/385
8,561,951 B2 * 10/2013 Wills ..... A01G 25/00 248/71
D703,369 S * 4/2014 Jones ..... D26/114
D706,893 S * 6/2014 Diederich ..... D21/840
8,985,061 B2 * 3/2015 Royals ..... A01K 1/04 119/786
9,097,112 B2 * 8/2015 Meline ..... E21D 20/003
D738,102 S * 9/2015 Goldszer ..... D3/17
9,271,335 B1 * 2/2016 Lamb ..... H05B 3/34
D752,414 S * 3/2016 Brooks ..... D8/349
9,376,781 B2 * 6/2016 Staller ..... E04H 12/2223
9,447,992 B2 * 9/2016 Johnson ..... F24T 10/17
9,528,235 B1 * 12/2016 Irving ..... E01H 5/10
D782,600 S * 3/2017 Brooks ..... D22/113
9,611,967 B2 * 4/2017 Dugan ..... F16L 9/18
D793,208 S * 8/2017 Valdez ..... D8/354
9,743,659 B2 * 8/2017 Brooks ..... A01M 31/00
9,869,177 B2 * 1/2018 Meline ..... E21D 20/003
9,872,342 B1 * 1/2018 Smith ..... H05B 1/0227
9,891,009 B2 * 2/2018 Lang ..... F28F 1/40
9,897,347 B2 * 2/2018 Breidenbach ..... E21B 7/205
9,909,783 B2 * 3/2018 Jensen ..... F24T 10/15
9,957,685 B2 * 5/2018 Yackley ..... E02D 5/80
10,054,372 B2 * 8/2018 Vendeirinho ..... F28D 20/0056
10,352,014 B1 * 7/2019 Baptiste ..... E02D 5/801
10,364,543 B2 * 7/2019 Yackley ..... E02D 5/801
2006/0051183 A1 * 3/2006 Powell ..... E02D 5/801 411/386
2007/0029067 A1 * 2/2007 Kidwell ..... F25B 30/06 165/45
2007/0131666 A1 * 6/2007 Gregg ..... E01C 11/265 219/213
2008/0000430 A1 * 1/2008 Petersen ..... A01K 27/004 119/786
2008/0012436 A1 * 1/2008 Neal ..... H02K 1/04 310/54
2008/0018181 A1 * 1/2008 Neal ..... H02K 9/20 310/54
2008/0197122 A1 * 8/2008 Gober ..... B60J 1/2011 219/203
2008/0302028 A1 * 12/2008 Lewenhoff ..... E02D 7/22 52/157
2008/0307721 A1 * 12/2008 Schultz ..... E04H 12/2215 52/157
2009/0107650 A1 * 4/2009 Feldmann ..... F24T 10/15 165/45
2011/0005148 A1 * 1/2011 Foster ..... E02D 5/801 52/157
2013/0153169 A1 * 6/2013 Perryman ..... F28D 20/021 165/10
2014/0020310 A1 * 1/2014 Lee ..... E02D 7/22 52/157
2014/0332645 A1 * 11/2014 Brooks ..... F16M 11/041 248/156
2015/0040491 A1 * 2/2015 Frank ..... E02D 27/00 52/157
2015/0377522 A1 * 12/2015 Ziegenfuss ..... F24T 10/15 165/45
2016/0032551 A1 * 2/2016 Yackley ..... E02D 5/80 52/156
2016/0270518 A1 * 9/2016 Brooks ..... A45F 3/44
2016/0281316 A1 * 9/2016 Brooks ..... F41B 5/1453
2016/0290681 A1 * 10/2016 Lieskoski ..... F28D 1/0472
2019/0010672 A1 * 1/2019 Yackley ..... E02D 5/80
2019/0242628 A1 * 8/2019 Saavedra ..... F25B 27/00

* cited by examiner

SNOW AND ICE MELTING DEVICE, SYSTEM AND CORRESPONDING METHODS

TECHNICAL FIELD

The disclosed embodiments generally relate to a snow melting device, and more specifically to a snow melting device designed to melt snow beneath and around the device utilizing solar energy.

BACKGROUND

Snow and ice melting devices typically comprise a system using chemicals that produce heat or lower the melting point of snow or ice, or using electrically or electronically produced heat in order to melt snow and ice. As such, these systems are often used in colder climates to remove snow and ice that accumulates on surfaces such as driveways, sidewalks, parking lots and the like. Also, snow and ice melting devices have been designed to eliminate the need to physically remove snow or ice from a location by shoveling, snow-blowing or plowing.

Currently various snow and ice melting devices are on the market that utilize chemicals, electricity, or some heat exchange medium. Chemicals are corrosive, require constant reapplication and timing according to weather conditions, and frequently have a negative impact on the environment. Electrical systems can be complex and costly to install and maintain, and also may not be moved easily from one location to another. Systems which transfer solar energy from a collecting medium to a heat exchange medium in order to melt snow may be energetically inefficient. Also, both chemicals and electricity typically aid melting but not evaporation, which can cause pooling of water into large puddles which may refreeze and become hazardous. Additionally, these existing processes for melting snow and ice are relatively slow.

Thus there is a need in the art fora product and system that address all of the above listed disadvantages while remaining light weight, easy to handle and relocate, low cost, non-corroding and high efficiency.

SUMMARY

A first embodiment described herein is a snow and ice melting device that comprises a spiral shaped coil comprising a taper, wherein the taper increases the individual rotational ability of the device to work itself down into a pile of snow or ice rather than sitting on the surface, a notched, grooved or porous surface that facilitates capillary action and thus evaporation of melt water, and a pitch geometry that enables placement within close proximity to other coils.

Another embodiment described herein is a device configured to melt at least one of snow and ice, comprising a coil formed from an elongated member having a first end and a second end, the elongated member having a surface comprising at least one of grooves, notches and pores configured to facilitate movement of liquid by capillary action.

A further embodiment is a method of melting at least one of snow and ice, comprising forming a coil comprising an elongated member having a first end and a second end, the elongated member being formed from a material that absorbs radiant solar energy, and having a surface comprising at least one of grooves, notches and pores configured to facilitate movement of liquid by capillary action, connecting the coil to at least one other coil having a similar configuration, and placing the connected coils in contact with at least one of snow and ice.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Sustained temperatures above 32 degrees Fahrenheit are generally required to melt snow and ice. Even during winter months in cold climates, the sun creates a sufficient amount of energy required to achieve this. However, due to the Albedo effect, 90 percent of that energy is reflected by snow and ice, rather than being absorbed. Thus, snow remains intact even after exposure to bright sunlight.

In one embodiment, the device can interrupt the Albedo effect by enabling absorption of radiant solar energy and direct conversion to thermal energy. The device then conducts thermal energy to the surrounding snow and ice, more efficiently melting it. The resulting melt water is then drawn upwards onto the surface of the device not in contact with the ground by capillary action, where it can then evaporate.

In embodiments, the device comprises a spiral shaped coil to melt snow and ice. The cross-sectional shape of the spiral coil is not limited to a circular-shaped spiral. It can be oval, rectangular, triangular or can have other possible geometries.

Figure 1:
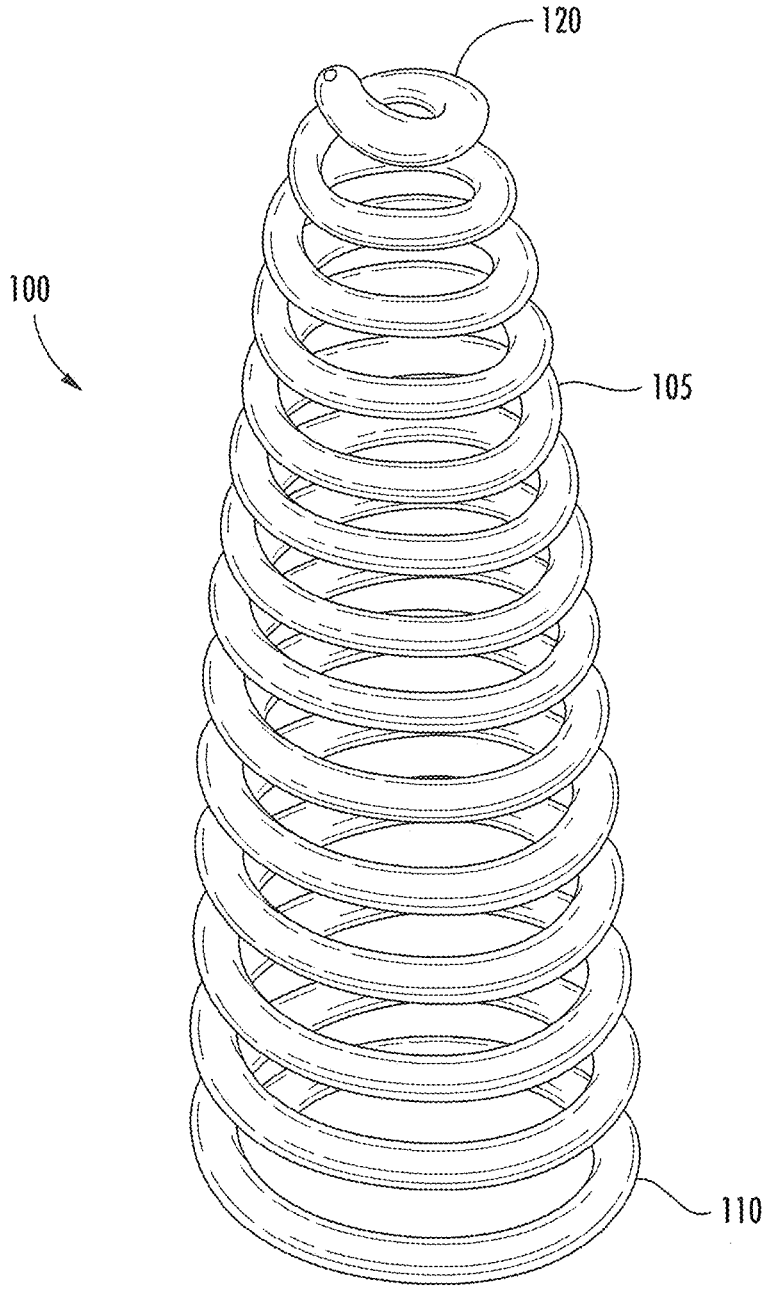
FIG. 1 is a perspective view of a three dimensional rendering of a spiral coil according to a first embodiment.
Figure 9:
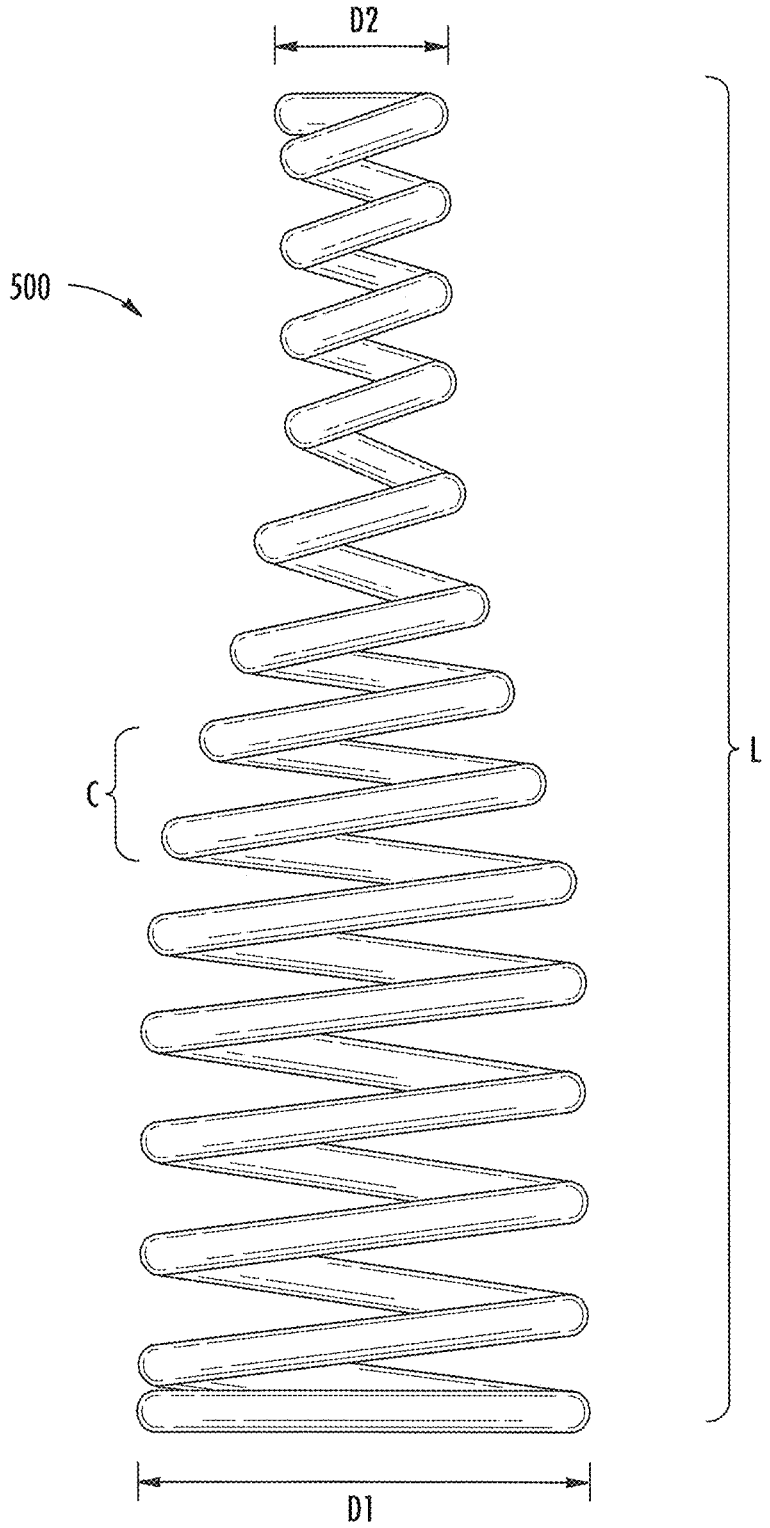
FIG. 9 shows a side view and variable pitch of a fifth embodiment of a coil.

FIG. 1 shows a perspective view of a three dimensional rendering of a spiral coil 100 with a generally circular-shaped cross section. The spiral coil 100 has an exterior surface 105. In this embodiment, the spiral coil gradually decreases its radius from the bottom end 110 to the top end 120 and forms a taper. In another embodiment, the coil can have same radius from the top to the bottom. In another embodiment, the geometry of the coil can be a spindle. In another embodiment, the geometry of the coil can be a variable pitch, as is shown in FIG. 9.

Figure 2:
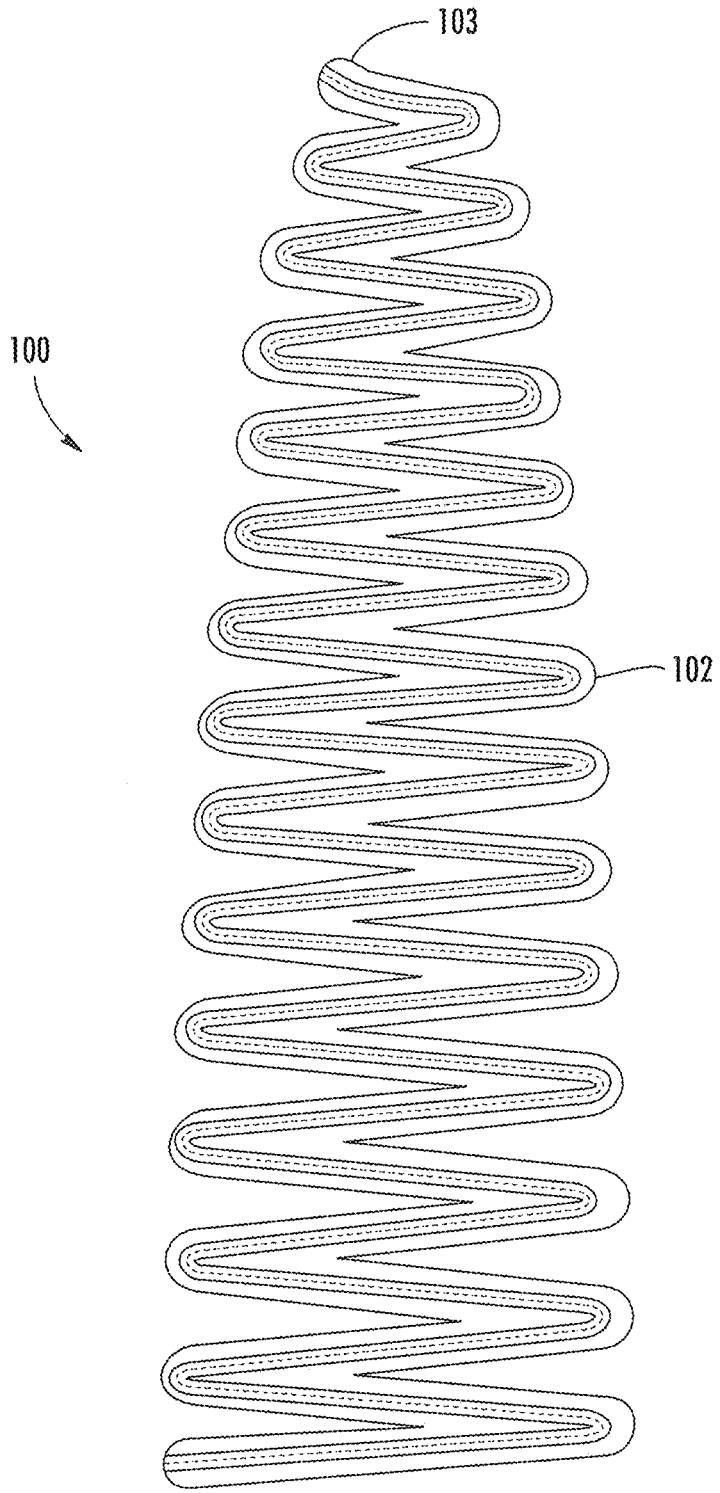
FIG. 2 is a front view of a three dimensional rendering of the coil showing capillary geometry.

FIG. 2 shows a front view of the spiral coil 100 showing its capillary geometry 102, with a dashed line representing the melt water's placement and exterior meniscus. When snow or ice melts, the melted water moves against the pull of gravity away from the ground via capillary action and will evaporate with exposure to heat and air movement. The upper terminal end 103 of the spiral coil 100 is shown in the Figure.

Figure 3:
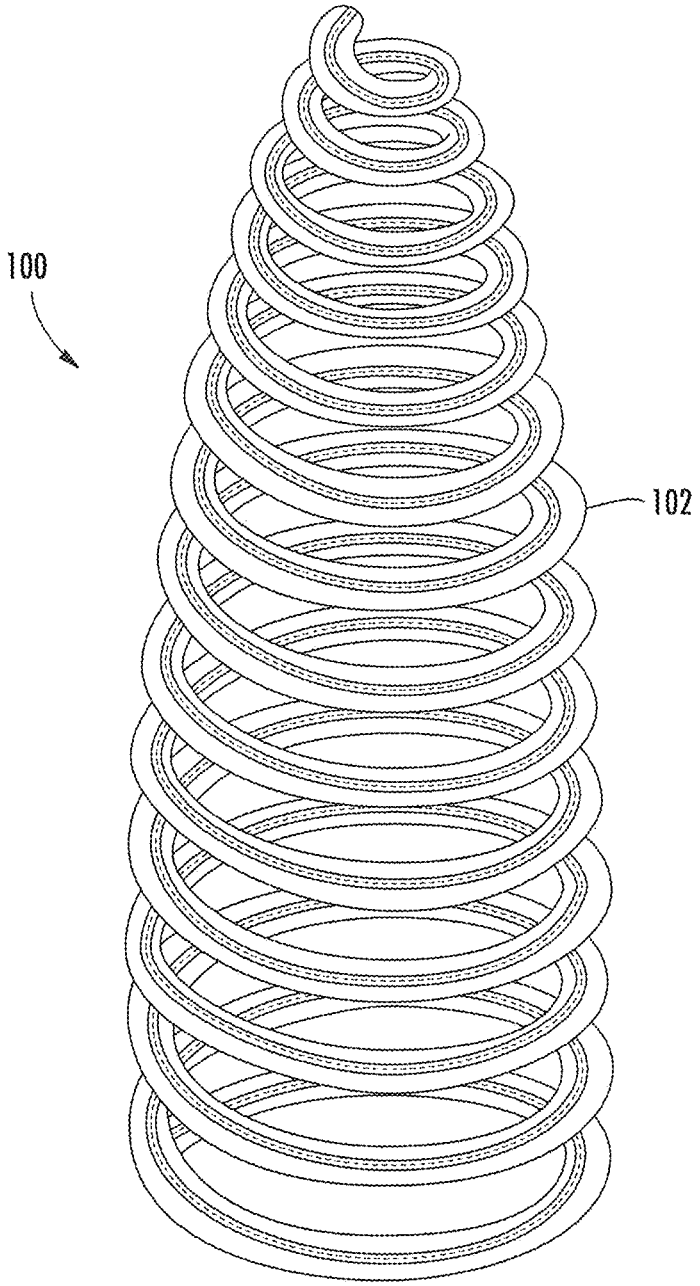
FIG. 3 shows perspective view of the capillary geometry of the coil.
Figure 4:
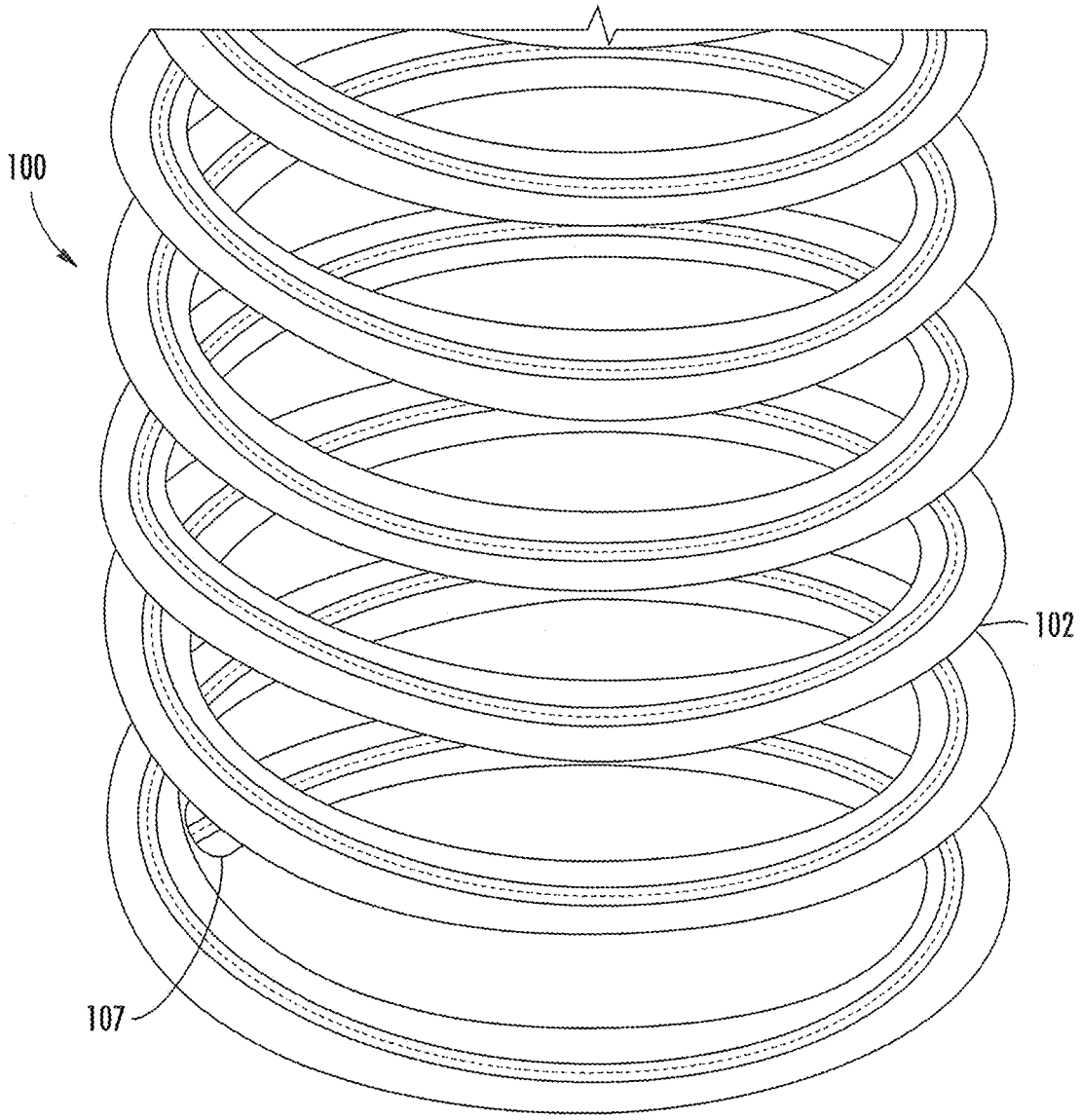
FIG. 4 shows a close-up perspective view of the capillary geometry of the spiral coil.

FIG. 3 shows a perspective view of the capillary geometry 102 of the spiral coil 100, with a dashed line representing the upward movement of melt water along the outer surface. FIG. 4 shows a close-up perspective view of the capillary geometry 102 of the spiral coil 100, with a lower terminal end 107 of the spiral coil 100 being shown. The coil can be porous or non-porous.

Figure 5:
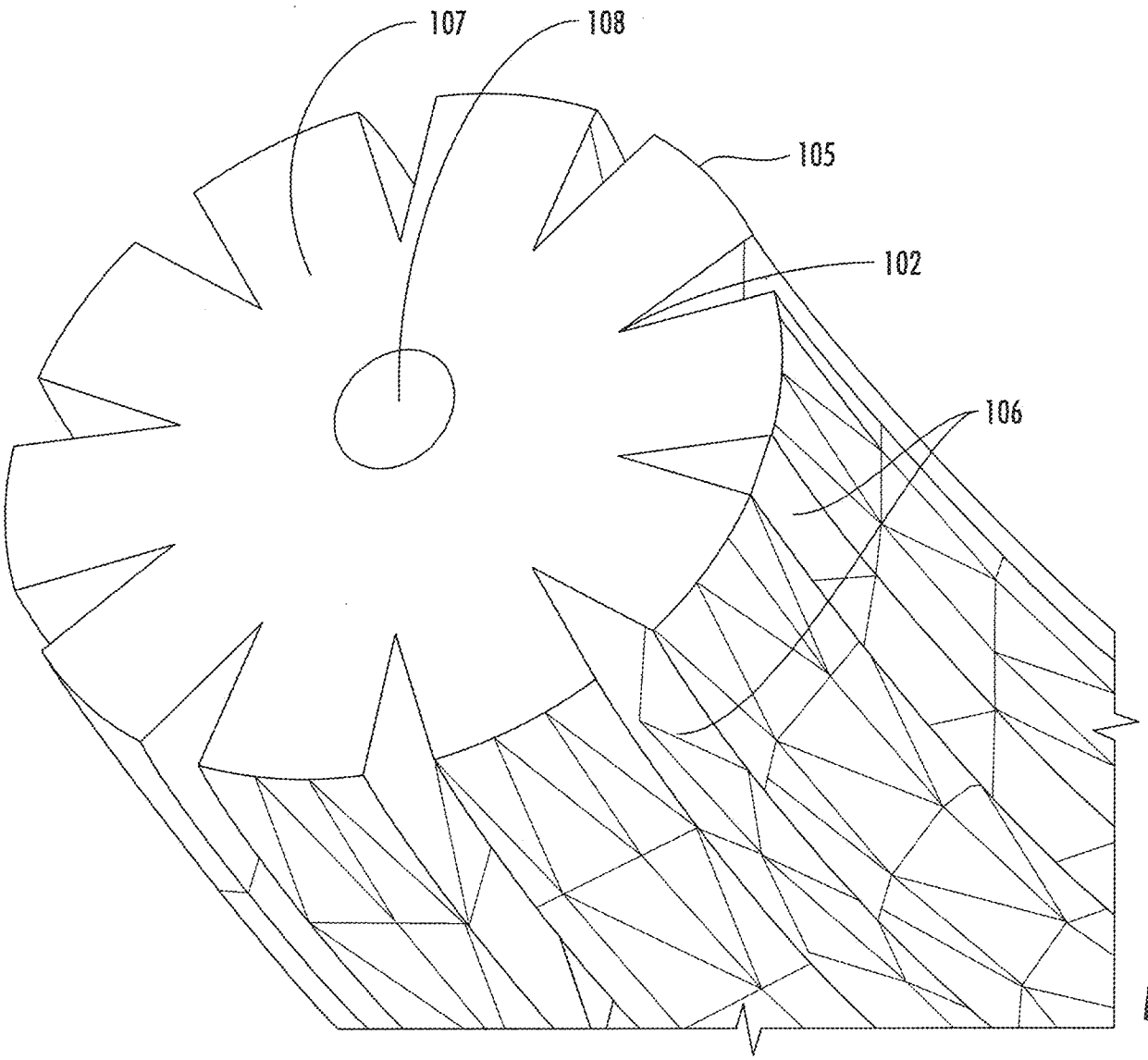
FIG. 5 shows is a close-up end view of the coil in cross section, showing capillary geometry.

FIG. 5 shows a close-up view of a coil cross section 104 for the spiral coil 100 showing an embodiment of a capillary geometry 102 that is facilitated by a plurality of grooves 106 extending along the length of the spiral coil 100 on the outer surface 105. The water layer or exterior meniscus is most obvious inside the grooves of the coil 100 but will also be present in some degree on the outer surface 105. Movement of the water from melted snow and/or ice against gravity due to capillary action, and evaporation of the water, can be effected using various surface geometries, including notches, bands, grooves, flutes, channels, indentations, protuberances, etc. In embodiments, use of a porous material will typically improve upward movement of melt water against gravity. In embodiments, various surface texture patterns can be used on the outer surface 105 of the spiral coil 100 that facilitate upward movement and/or evaporation of the melt water. As is shown, the coil 100 can have a central opening 108.

Figure 6:
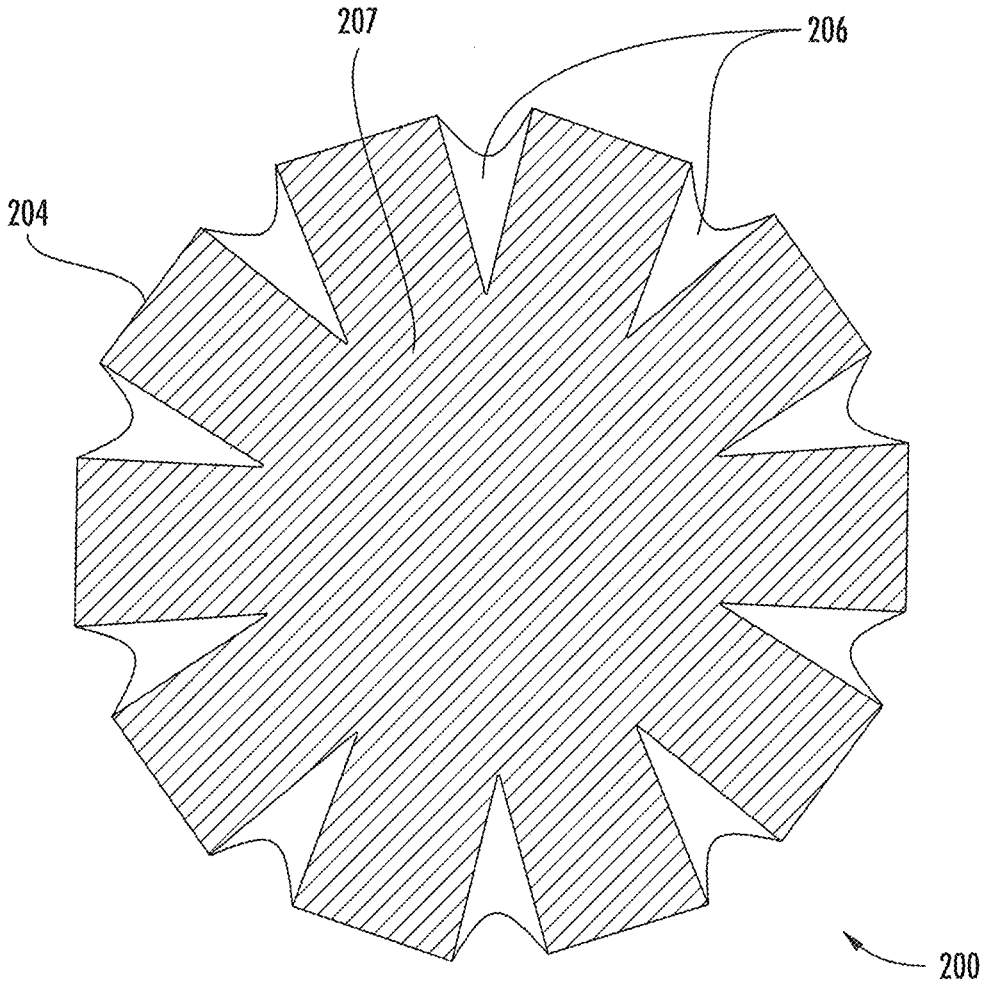
FIG. 6 is a close-up view of a second embodiment of a coil.

FIG. 6 shows an embodiment of a close-up end view of a cross-section 204 of a second embodiment of a spiral coil 200. The spiral coil 200 optionally has a notched, grooved, or otherwise textured outer surface 206, and/or a porous outer surface. In this embodiment, the spiral coil 200 has a coil wall 207. In embodiments, the spiral coil 200 is formed by extrusion. In embodiments, the pattern of notches or grooves on the coil surface may not be as evenly spaced as the grooves 206 shown in FIG. 6. The pattern can be random or the notches, grooves, and/or other surface formations can be aggregated on one particular side of the spiral coil 200.

In embodiments, the spiral coil is formed by extrusion and subsequent shaping of a length of extruded material, such as a resin composite. In embodiments, the coil is formed by injection molding, compression molding, or an additive manufacturing technique such as 3D printing or vat polymerization.

Figure 7:
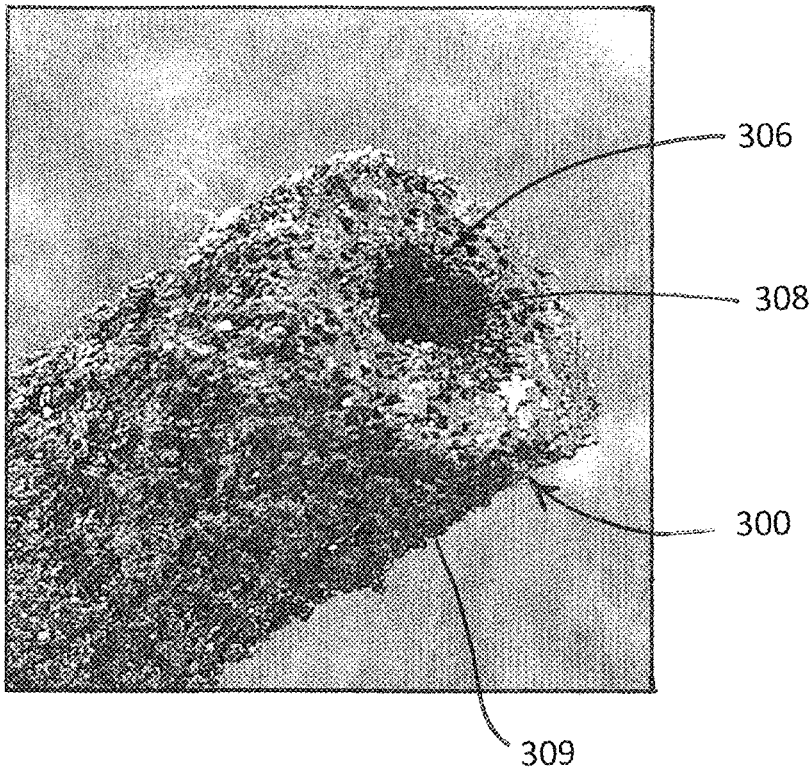
FIG. 7 shows a close-up view of the porous surface and hollow core of a third embodiment of a coil, which can be extruded.

FIG. 7 shows a close up photo of a third embodiment of an end of a coil 300 with a porous inner surface 306, a porous outer surface 309 and a central opening comprising a hollow core 308. In some cases, only one of the inner surface 306 and the outer surface 309 is porous.

Figure 8:
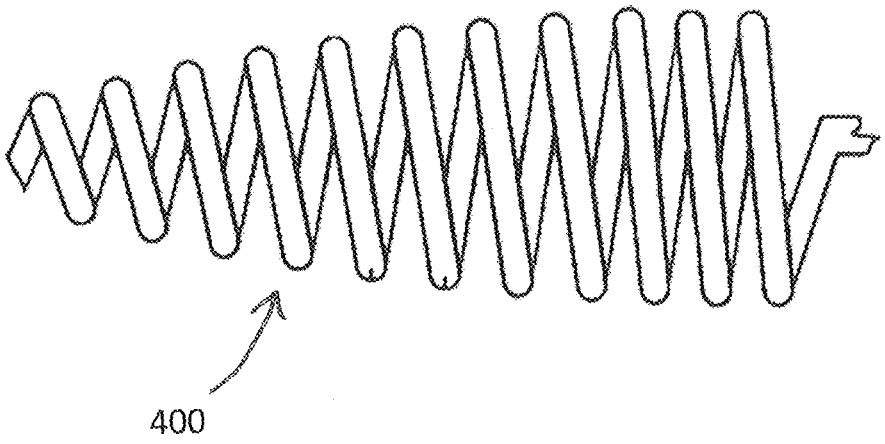
FIG. 8 shows a side view and dimensions of the fourth embodiment of the coil.

FIG. 8 shows a side view and dimensions of a fourth embodiment of a spiral coil 400. The size of the spiral coil 400 can vary widely to be suitable for its application in different locations. For example, when it is used to melt snow or ice in a parking lot or a back yard, the coil can have a large diameter at its lower end. When it is applied to get rid of snow or ice in a porch or on a car, it can be relative small.

FIG. 9 shows the various dimensions that can be selected in designing a spiral coil 500. In embodiments, the length L of a spiral coil can be from about 6 inches to about 24 inches, or about 10 inches to about 20 inches, or about 12 inches to about 18 inches. In embodiments, a diameter at its widest point D1 can be from about 28 inches to about 3 inches or about 20 inches to about 8 inches, or about 18 inches to about 12 inches. The smaller end diameter D2 can be from about 0.2 inches to about 10 inches, or about 0.5 inches to about 5 inches, or about 1 inch to about 3 inches. In embodiments, the space C between two adjacent rings can be from about 0.3 inches to about 4 inches, or about 0.5 inches to about 3 inches, or about 1 inch to about 2 inches.

In some cases, the taper may increase the individual rotational ability of the device to work itself down into a pile of snow or ice rather than sitting on top of the surface. The taper variability also allows the coil to remain effective in bright, still conditions and remain uncovered in blowing snow conditions.

FIG. 9 shows variable pitch, i.e. variable spacing between rotations, of the coil 500. The resulting pitch geometry of the coil 500 may enable tethering and placement within close proximity to other coils in either a flat circular assembly, an alternating parallel assembly, or a combination. The pitch geometry may also increase the variability of contact with the snow surface.

The color of the coil can vary. On the one hand, radiant energy from the sun is efficiently absorbed by the dark colored coil and converted into thermal energy. This heat is conducted throughout the coil. The portion of the coil in contact with snow and ice is sufficiently and continually heated to cause melting. On the other hand, the color of the device can provide aesthetic appealing to clients. It is not limited to black.

Figure 10:
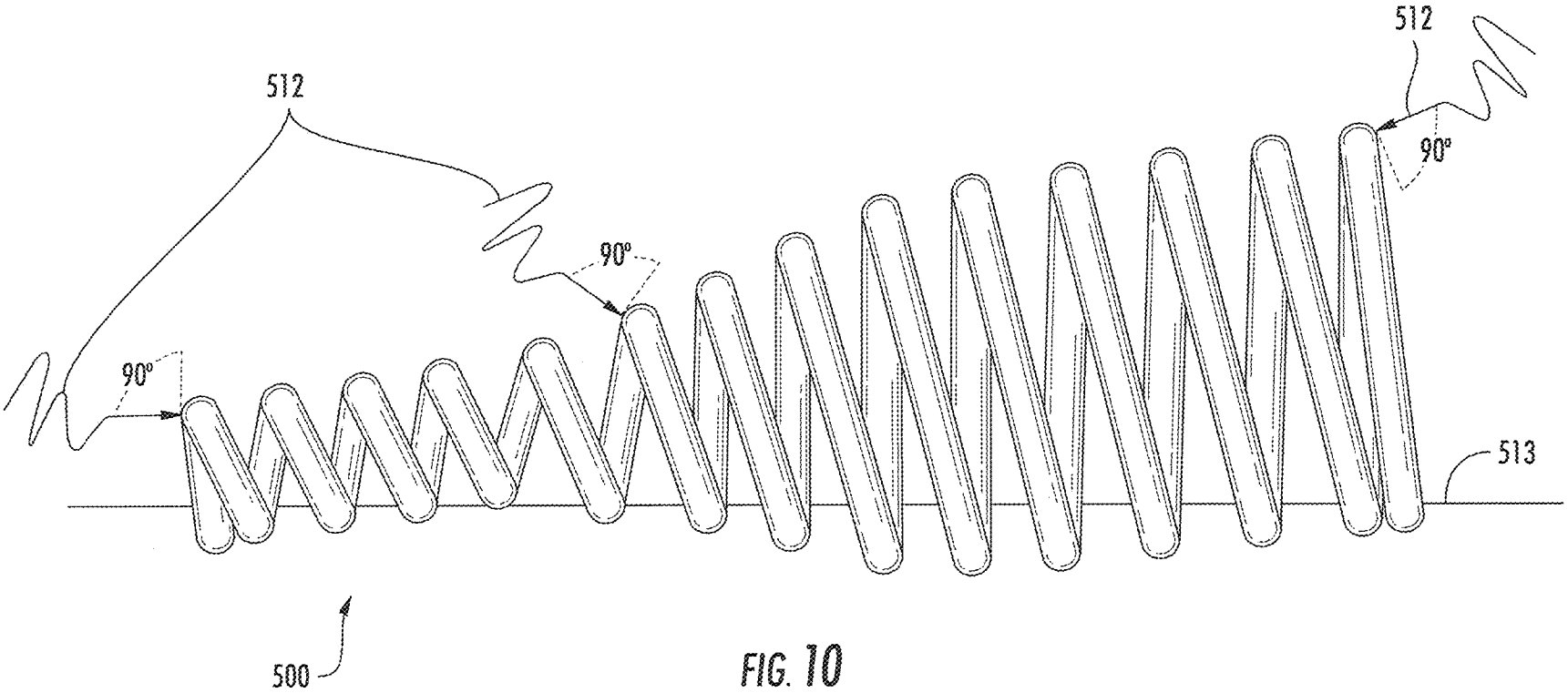
FIG. 10 is a schematic view of the fifth embodiment that shows how solar energy is efficiently absorbed by the coil and converted to heat used to melt proximal snow and ice.

In embodiments, the coil's shape, geometry, size and dimensions present a constant 90 degree angle to the sun's rays which maximizes radiation absorption at low winter sun elevations. FIG. 10 is a schematic drawing that shows how solar energy is efficiently absorbed by the coil 500 positioned on snow 513 and converted to heat used to melt proximal snow and ice. The incident rays of sunlight 512 can contact the coil 500 because multiple faces of the device are always perpendicularly exposed, despite the device's positioning or the position of the sun in the sky. This process can occur at temperatures below the freezing point of water because even low winter sun angles are maximally captured by the compound curves and spiral geometry of the invention.

Figure 11:
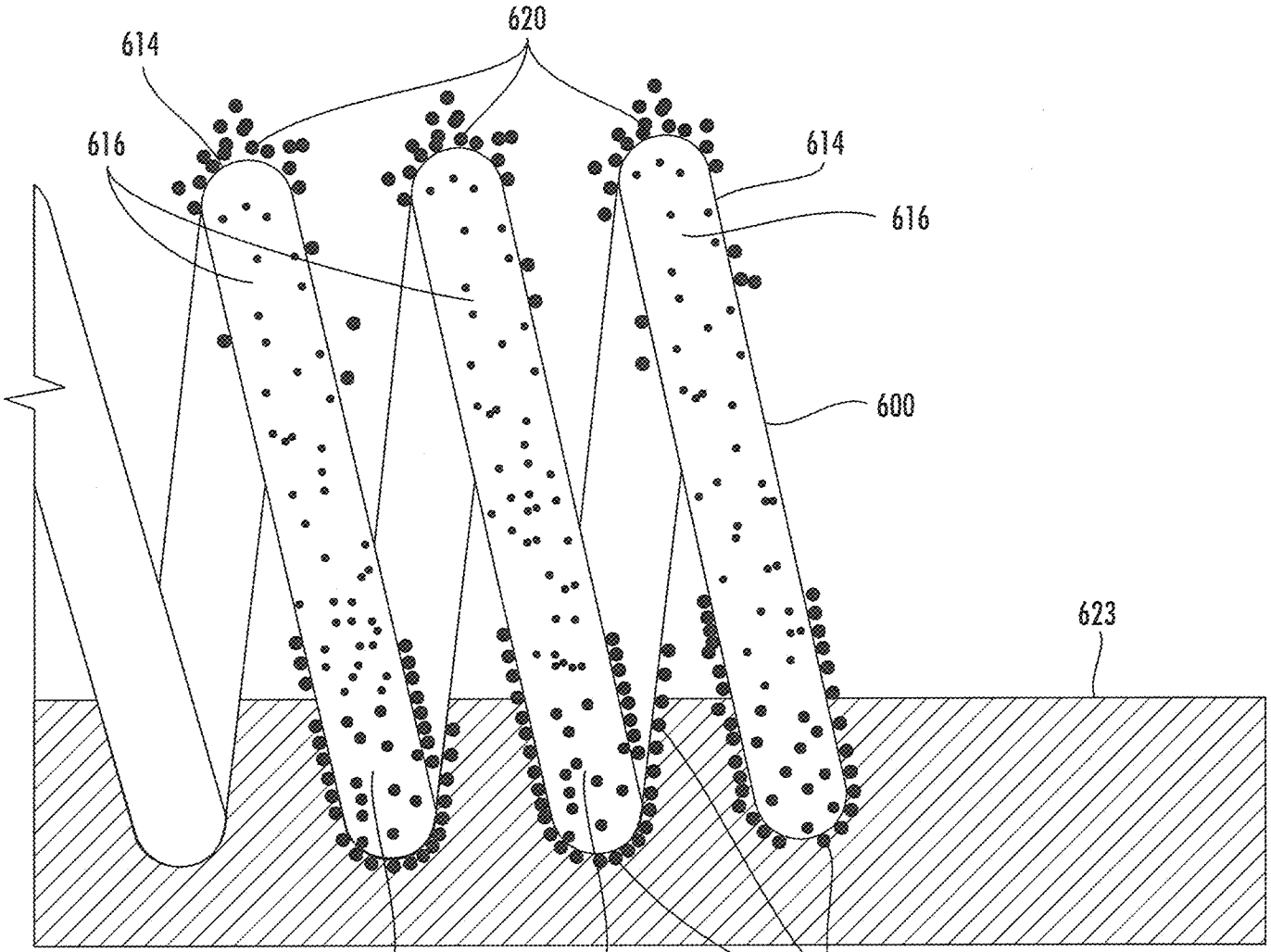
FIG. 11 is a partial schematic view of a sixth embodiment that shows how the translocation and capillary action of the coil increases evaporation efficiency.

FIG. 11 is a schematic drawing that shows how the translocation and capillary action of the coil 600 increases evaporation efficiency in one embodiment. The transition from ice and snow to liquid water occurs at the juncture between the snow and the coil, and is shown by particles 622. The transition from liquid water to water vapor occurs along the portions of the coil that are exposed to the air and is shown by particles 620. The portion 616 of the coil 600 that is above the snow line 623 (the location of snow particles is shown by the cross hatch pattern 623) allows particles (water molecules) 620 to evaporate from its surface 614. The increased wind speed found about 2-3 inches above the snow line greatly increases the evaporation efficiency and rate. The portion 618 of the coil 600 that is below the snow line includes particles 622. Upon melting, particles 622 move away from the portion 618 of the coil 600 that is below the snow line 623 via translocation and capillary action against the force of gravity. The constant evaporation of particles 620 above the snow line greatly increases the rate of snow melt.

Typically, melt water refreezes, which stalls the melting process. In one embodiment, the device melts snow in between storm events and thus prevents or reduces the buildup of resulting precipitation. The rate of melting is dependent on sunlight intensity, time of exposure, the evaporative effect, humidity levels, wind speed, and density of surrounding ice and snow. Occasional readjustment of tethered assemblies or individual coils of the disclosed embodiments onto the surface of remaining snow and ice will also increase melt rate.

In embodiments, the device may comprise a thermally conductive material. The material can be metal, thermoplastic, thermoset, ceramic, and/or otherwise filled thermoplastic or thermoset material, or other suitable thermally conductive material. In one embodiment, a thermoplastic resin polymer is used to make the device. This type of material has advantages of light weight, easy handling, and cost efficiency. The thermoplastic resin is configured as a generally spiral compound curve. In embodiments, the coil is formed from a material having a thermal conductivity of at least 2 watts per meter-Kelvin. The resin blend can be modified to maximize thermal conductivity in the range of 2-20 watts per meter-Kelvin (W/mK), or about 6 to about 16 W/mK, or about 10 to about 14 W/mK. In embodiments, the thermoplastic resin can be produced at a low cost of production by extrusion, injecting molding compression molding or similar methods, often requiring secondary thermoforming to achieve a spiral shape. In one embodiment, the surface of thermoplastic resin can be partially or completely coated by a metal. A wide selection of metal types can be used. Non-limiting examples of suitable metals include copper, silver and/or iron, and combinations thereof. Non-limiting examples of suitable thermoplastic and thermoset materials include composites and copolymers formed from polyethylene, polypropylene, nylon and or polyurethane that, in some cases, have been modified to increase their thermal conductivity. Darkening pigments can be added to the bulk material, or coated on the outer surface, to increase the rate of absorption of radiant solar energy by the material. The surface exhibits hydrophilic tendencies.

Figure 12:
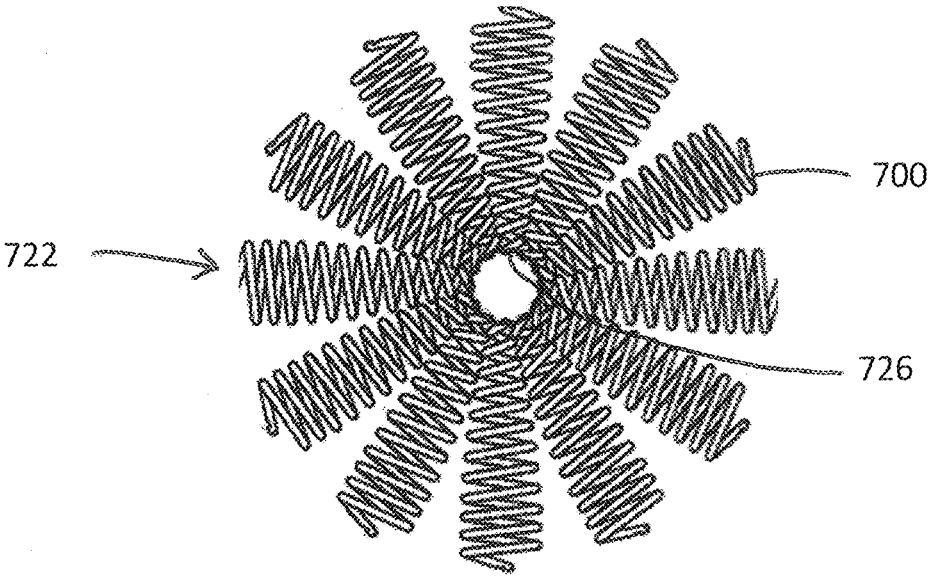
FIG. 12 shows a flat circular assembly of multiple individual coils tethered together.
Figure 13:
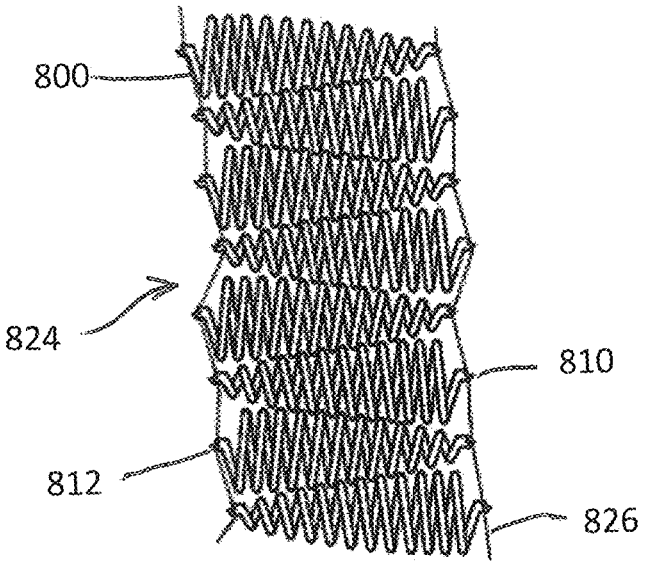
FIG. 13 shows an alternating parallel assembly of multiple individual coils tethered together.

The device may consist of individual coils, or tethered assemblies consisting of a plurality of coils linked or otherwise connected together, arranged in flat circular, alternating parallel or other arrangements. FIGS. 12-13 show non-limiting examples of snow and ice melting systems formed from multiple coils. FIG. 12 shows one embodiment of a flat circular assembly 722 of multiple individual coils 700 tethered together using a wire, rope, thin cable 726, or the like. The flat circular assembly 722 is tethered on the narrowing end in order that the axes of the individual coils extend radially outwardly relative to one another. The other end can be tethered as well. Each coil is free to move within the assembly. The pitch geometry enables individual coils to nestle within each other's spaces to increase surface area. FIG. 13 shows an alternating parallel assembly 824 of multiple individual coils 800 tethered together by linking their terminations 810, 812 on a tether 826 (shown by black lines) in order that the axes of the individual coils are side-by-side and parallel to one another. An alternating parallel assembly 824 is thus achieved for use on straight paths. Each coil 800 can also be used individually without a tether 826.

The dimensions of the device can accommodate weather conditions ranging from light blowing snow to being placed on many feet of heavy, compacted snow and ice. The device is able to rest on top of the surface on which it is placed without being completely covered by falling precipitation, unlike a thin flat sheet of plastic or other material which could become buried. The device is also able to roll along a surface, so that some portion is constantly exposed to the sun. This maximal exposure of the device to the sun increases melting and evaporative activity.

The ends of each spiral cone or coil are finished to facilitate tethering, and because of the consistent geometry, individual coils can be stacked inside one another for easy storage and shipping. The coils can be reused over several winter seasons without a decrease in functionality. In embodiments, the coil comprises an elastic spring that flattens if it is stepped on by a walker.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed:

1. A snow and ice melting device that comprises:

multiple spiral shaped coils, each having an axis, wherein each coil is formed from, or coated with, a material that absorbs radiant solar energy and each coil having:

a helical shape with a decreasing radius along the axis;

a notched, grooved or porous outer surface that facilitates capillary action and thus evaporation of melt water; and a pitch geometry that enables placement within close proximity to other coils, and a tether that fastens multiple coils in a fixed configuration comprising one of:

a first configuration with the respective axes being side-by-side and parallel to one another, and a second configuration with the respective axes extending radially relative to one another.

2. The snow and ice melting device of claim 1, wherein each coil is about 6 inches to about 24 inches in length.

3. The snow and ice melting device of claim 2, wherein each coil has a circular or oval cross section with a diameter of about 2 inches to about 8 inches at its widest point.

4. The snow and ice melting device of claim 3, wherein each coil has a space of about 0.3 inches to about 4 inches between corresponding points on adjacent curves.

5. The device of claim 1, wherein each coil is formed from at least one of a thermoplastic and a thermoset material.

6. The device of claim 5, wherein the at least one of a thermoplastic and thermoset material is coated with, or combined with, a metal.

7. The device of claim 1 wherein each coil is formed from a thermoplastic material partially or completely coated by a metal.

8. The device of claim 7, wherein the thermoplastic material comprises at least one of polyethylene, polypropylene, nylon and polyurethane.

9. The snow and ice melting device of claim 1, wherein each coil comprises a hollow core.

10. The device of claim 1, wherein the liquid is water.

11. The device of claim 1, wherein the outer surface of each coil comprises pores.

12. The device of claim 1, wherein each coil is formed from a material having a thermal conductivity of at least 2 watts per meter-Kelvin.

13. The device of claim 1, wherein each coil is non-electric and non-electronic.

14. The device of claim 1, wherein: each coil is formed from a thermoplastic or thermoset material and is non-electric and non-electronic, the tether fastens the coils in the first configuration in an alternating parallel assembly, and each coil has a length in the range of 10 to 24 inches and a diameter at its widest point in the range of 8 to 20 inches.

15. The device of claim 1, wherein: each coil is formed from a thermoplastic or thermoset material and is non-electric and non-electronic, the tether fastens the coils in the second configuration, and each coil has a length in the range of 10 to 24 inches and a diameter at its widest point in the range of 8 to 20 inches.

16. A method of melting at least one of snow and ice, comprising:

forming a coil comprising an elongated member having a first end and a second end, the elongated member being formed from a material that absorbs radiant solar energy, wherein the coil is formed to have a helical shape with an axis, and an outer surface comprising at least one of grooves, notches and pores configured to facilitate movement of liquid by capillary action;

connecting the coil to at least one other coil having a similar configuration using a tether that fastens multiple coils in a fixed configuration comprising one of:

a first configuration with the respective axes being side-by-side and parallel to one another, and a second configuration with the respective axes extending radially relative to one another, and placing the connected coils in contact with at least one of snow and ice.

17. The method of claim 16, wherein the coil has a decreasing radius along the axis.

* * * * *